US008552667B2

(12) United States Patent
Allen et al.

(10) Patent No.: US 8,552,667 B2
(45) Date of Patent: Oct. 8, 2013

(54) LINEAR ACCELERATOR

(75) Inventors: John Allen, Haywards Heath (GB); Terry Arthur Large, Linfield (GB)

(73) Assignee: Elekta AB (Publ), Stockholm (SE)

( * ) Notice: Subject to any disclaimer, the term of this patent is extended or adjusted under 35 U.S.C. 154(b) by 231 days.

(21) Appl. No.: 13/047,301

(22) Filed: Mar. 14, 2011

(65) Prior Publication Data

US 2012/0235602 A1 Sep. 20, 2012

(51) Int. Cl.
*H05H 9/04* (2006.01)
*H05H 9/00* (2006.01)

(52) U.S. Cl.
USPC ..... 315/505; 315/500; 315/502; 250/423; 250/493.1

(58) Field of Classification Search
USPC ..... 315/500, 505; 250/423
See application file for complete search history.

(56) References Cited

U.S. PATENT DOCUMENTS 6,376,990 B1 * 4/2002 Allen et al. ..... 315/5.41
6,642,678 B1 * 11/2003 Allen et al. ..... 315/505
6,710,557 B1 * 3/2004 Allen et al. ..... 315/505
7,397,206 B2 * 7/2008 Yao ..... 315/505
7,619,363 B2 * 11/2009 Whittum et al. ..... 315/5.41
2007/0215813 A1 9/2007 Whittum et al.

FOREIGN PATENT DOCUMENTS

WO 9940759 A1 8/1999
WO 0111928 A1 2/2001
WO 2006097697 A1 9/2006

OTHER PUBLICATIONS

PCT Internationl Search Report Sep. 19, 2012.
PCT Written Opinion, Sep. 19, 2012.

* cited by examiner

*Primary Examiner* — Jerome Jackson, Jr.
*Assistant Examiner* — David Lotter
(74) *Attorney, Agent, or Firm* — Westman, Champlin & Koehler, P.A.; Z. Peter Sawicki

(57) ABSTRACT

The present invention provides a linear accelerator in which a rotatable conductive vane is employed to vary the electromagnetic coupling between adjacent accelerating cells. The vane is sealed off from the rest of the linear accelerator by an insulating partition, so the pressure around the vane can be higher than in the rest of the accelerator. This greatly simplifies the mechanisms which may be used to control the rotation of the vane, allowing a higher bakeout temperature in manufacture and a higher rate of rotation in use.

13 Claims, 6 Drawing Sheets

LINEAR ACCELERATOR

FIELD OF THE INVENTION

The present invention relates to linear accelerators (linacs), and particularly to linear accelerators with varying energy owing to coupling cells having a rotatable vane.

BACKGROUND ART

In the use of radiotherapy to treat cancer and other ailments, a powerful beam of the appropriate radiation is directed at the area of the patient that is affected. This beam is apt to kill living cells in its path, hence its use against cancerous cells, and therefore it is highly desirable to ensure that the beam is correctly aimed. Failure to do so may result in the unnecessary destruction of healthy cells of the patient.

Several methods are used to check this, and devices such as the Elekta™ Synergy™ device employ two sources of radiation, a high energy accelerator capable of creating a therapeutic beam and a lower energy X-ray tube for producing a diagnostic beam. Both are mounted on the same rotatable gantry, separated by 90°. Each has an associated flat-panel detector, for portal images and diagnostic images respectively.

In our earlier application WO-A-99/40759, we described a novel coupling cell for a linear accelerator that allowed the energy of the beam produced to be varied more easily than had hitherto been possible. In our subsequent application WO-A-01/11928 we described how that structure could be used to produce very low energy beams, suitable for diagnostic use, in an accelerator that was also able to produce high-energy therapeutic beams.

In both these earlier applications, the energy of the beam was adapted by rotating a vane in the cells coupling adjacent accelerating cells of the linear array. In our yet further application, WO-A-2006/097697, we described an adaptation of that structure which allowed the apparatus to produce closely interspersed pulses of high-energy and low-energy radiation beams. By rotating the vane at high speed and pulsing the radiation beam in a like manner, the energy of radiation pulses can be easily adapted by varying the frequency of the vane rotation.

The disclosure of each of these three prior applications is hereby incorporated by reference. The reader should note that this application develops the principles set out in those applications, which should therefore be read in conjunction with this application and whose disclosure should be taken to form part of the disclosure of this application.

This latter arrangement presents a problem in that the vane is internal to the linear accelerator and therefore under vacuum. The vane is rotationally driven by means of a "wobblestick" coupling. In this arrangement (see FIG. 1), a first shaft 50 extends from the rotatable vane inside the coupling cavity to the exterior of the linear accelerator. Outside the cavity, the shaft is bent at an angle and the angled end welded to a set of flexible bellows 52. A vacuum exists inside the bellows and around the first shaft. A second shaft 54 is bent at a corresponding angle, and couples loosely to the outside of the bellows 52 and hence the bent portion of the first shaft 50. In use, the second shaft 54 is driven rotationally as shown, with the rotational motion being conveyed to the first shaft 50 inside the coupling cavity, and causing the vane 22 to rotate.

However, the loose coupling between the drive shaft 54 and the internal shaft 50 places an upper limit on the speed with which the vane 22 can be driven. In addition, the flexible bellows 52 limit the temperature at which the linear accelerator can be "baked out", effectively limiting the vacuum quality of the system.

SUMMARY OF THE INVENTION

Embodiments of the present invention seek to address these issues.

In one aspect, a linear accelerator comprises a plurality of accelerating cavities arranged in a linear array, adjacent pairs of which are electromagnetically coupled via respective coupling cavities. At least one of the coupling cavities comprises a conductive element that is rotatable, thereby to vary the coupling offered by that coupling cavity. The conductive element is sealed off from the accelerating cavities by means of an electrically insulating partition.

This arrangement allows the pressure around the vane to be higher than the rest of the accelerator, greatly simplifying the mechanisms which may be used to control the rotation of the vane, and allowing a higher bakeout temperature in manufacture and a higher rate of rotation in use. For example, in one embodiment a coupling means extends through an external wall of the coupling cavity, for coupling the conductive element to a driving means external to the coupling cavity. The coupling means may also be sealed off from the accelerating cavities by the partition.

In one embodiment the conductive element comprises a flat vane. This may extend across substantially the entire length of the coupling cavity or less than half the length of the coupling cavity.

The insulating partition can take a variety of forms. In one embodiment, it seals off the entire coupling cavity from the adjacent accelerating cells. In an alternative embodiment the partition extends transverse to the axis of rotation of the conductive element, i.e. it cuts across the axis of the coupling cavity, restricting the conductive element to just a portion of the cavity. In a yet further alternative embodiment, the partition takes a cylindrical shape around the conductive element, with the axis of the cylinder running parallel to the rotation axis of the element.

Various insulating materials may be used in the partition. For example, the material may be dielectric and/or ceramic, such as high-density alumina.

BRIEF DESCRIPTION OF THE DRAWINGS

An embodiment of the present invention will now be described by way of example, with reference to the accompanying figures in which.

DETAILED DESCRIPTION OF THE EMBODIMENTS

Figure 1:
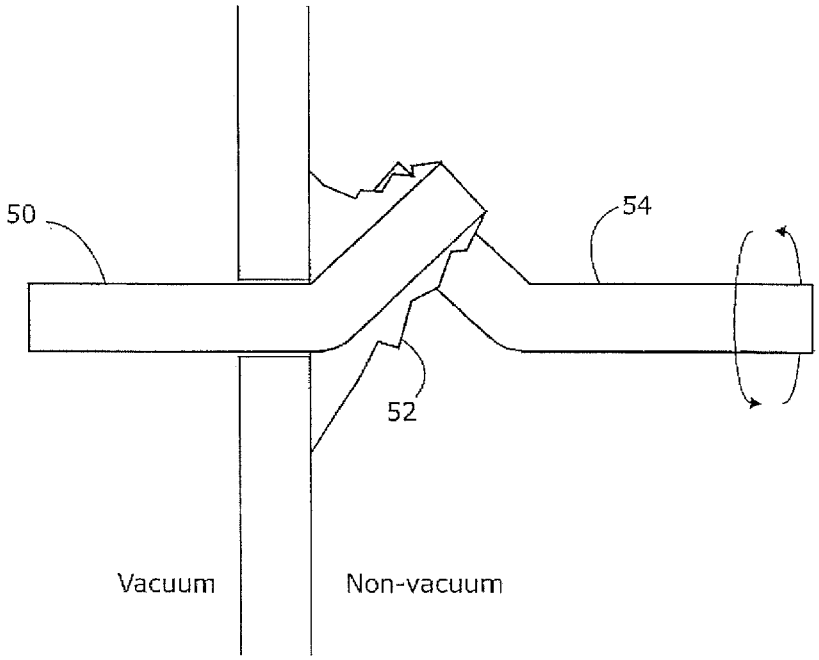
Fig. 1 PRIOR ART
FIG. 1 shows the conventional "wobblestick" rotational coupling between a driven shaft and a shaft under vacuum.
Figure 2:
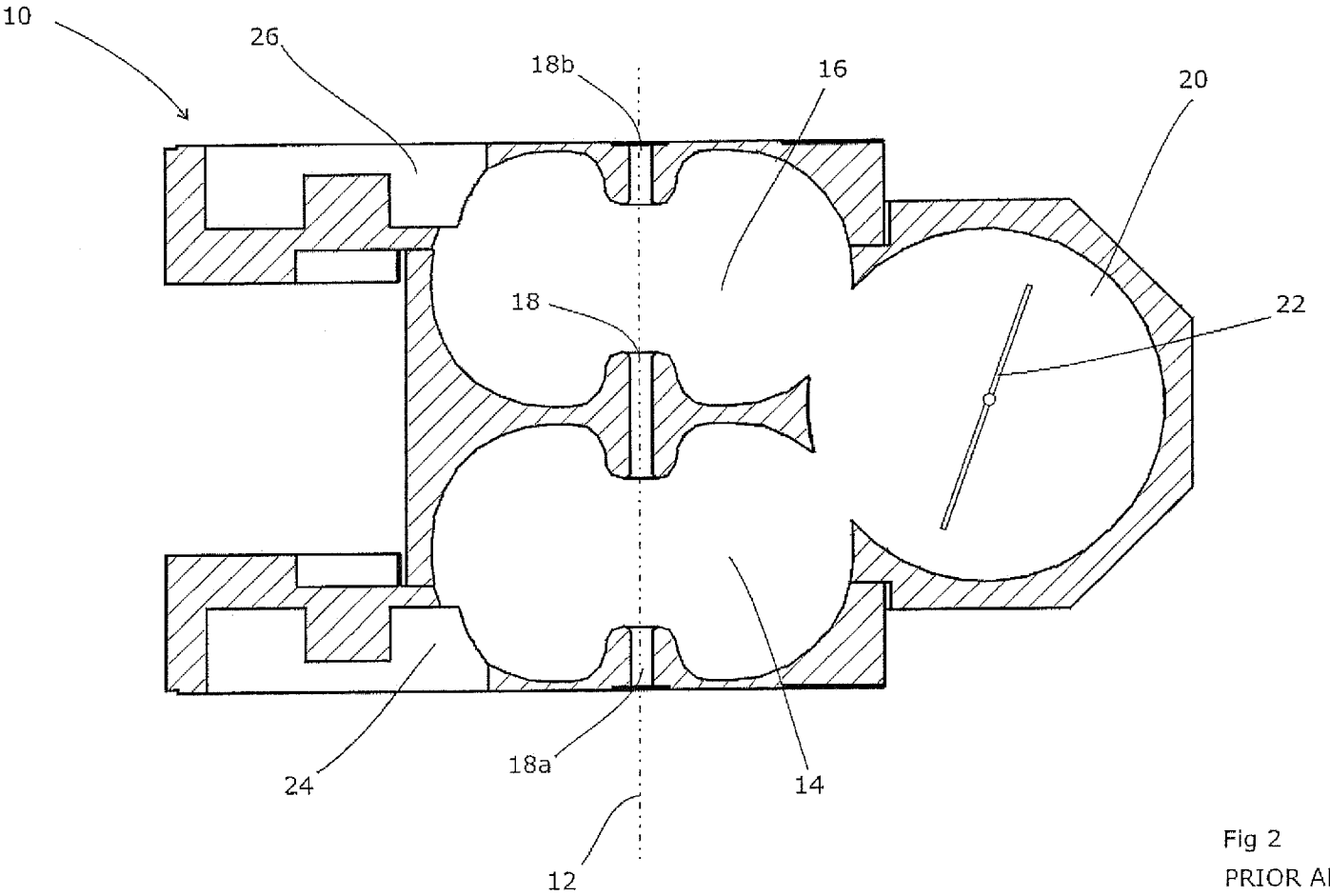
Fig 2 PRIOR ART
FIG. 2 shows a linear accelerator as described in earlier application no WO-A-99/40759.

FIG. 2 shows the coupling cavity of the linac 10 disclosed in WO-A-99/40759. A beam 12 passes from an '$n^{th}$' accelerating cavity 14 to an 'n+1$^{th}$' cavity 16 via an axial aperture 18 between the two cavities. Each cavity also has a half-aperture 18*a* and 18*b* so that when a plurality of such structures is stacked together, a linear accelerator is produced.

Each adjacent pair of accelerating cavities can also communicate via "coupling cavities" that allow the radiofrequency signal to be transmitted along the linac and thus create the standing wave that accelerates electrons (or other charged particles). The shape and configuration of the coupling cavities affect the strength and phase of the coupling. The coupling cavity 20 between the n$^{th}$ and n+1$^{th}$ cavities is adjustable, in the manner described in WO-A-99/40759, in that it comprises a cylindrical cavity in which is disposed a rotatable, electrically conductive vane 22. As described in WO-A-99/40759 and WO-A-01/11928 (to which the skilled reader is referred), this allows the strength and phase of the coupling between the accelerating cells to be varied by rotating the vane, as a result of the rotational asymmetry thereof.

It should be noted that the vane is rotationally asymmetric in that a small rotation thereof will result in a new and non-congruent shape to the coupling cavity as "seen" by the rf signal. A half-rotation of 180° will result in a congruent shape, and thus the vane has a certain degree of rotational symmetry. However, lesser rotations will affect coupling and therefore the vane does not have complete rotational symmetry; for the purposes of this invention it is therefore asymmetric.

The n$^{th}$ accelerating cavity 14 is coupled to the n−1$^{th}$ by a fixed coupling cell. That is present in the structure illustrated in FIG. 2 as a half-cell 24. This mates with a corresponding half-cell in the adjacent structure. Likewise, the n+1$^{th}$ accelerating cell 16 is coupled to the n+2$^{th}$ such cell by a cell made up of the half-cell 26 and a corresponding half-cell in an adjacent structure.

During operation of the linac 10, the coupling cavities 20, 24, and 26 and the accelerating cavities 14, 16 are all held at an ultra-high vacuum (i.e. pressures around or below $10^{-7}$ Pa). As described above this presents practical difficulties in driving the vane 22 to rotate, particularly if the vane should rotate at high speed as described in our application WO-A-2006/097697.

Figure 3:
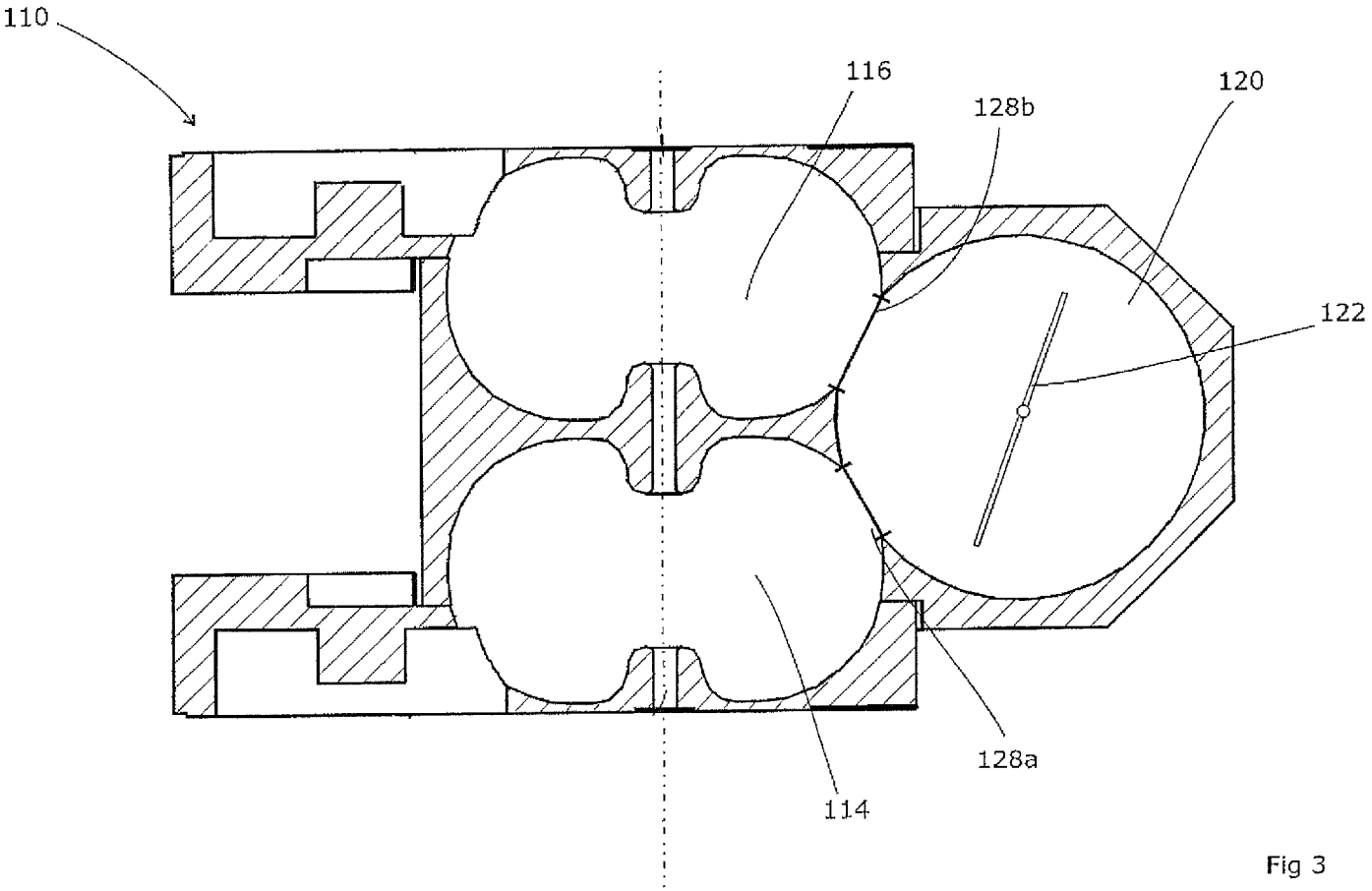
FIG. 3 shows a linear accelerator according to an embodiment of the present invention.

FIG. 3 shows a linac 110 according to one embodiment of the present invention. It can immediately be seen that the overall structure is nearly identical to that disclosed in our earlier applications.

The only additions relative to the conventional linac 10 of FIG. 2 are two insulating partitions 128*a* and 128*b* located in the openings between the coupling cavity 120 and the first accelerating cavity 114, and between the coupling cavity 120 and the second accelerating cavity 116 respectively. In this embodiment, the insulating material serves to seal off the entire coupling cavity 120 from the rest of the linac 110. Any insulating material suitable for use in ultra-high vacuums can be employed in the partition, for example ceramic materials such as high-density alumina ceramic.

The partitions 128*a*, 128*b* provide an air-tight barrier, allowing the coupling cavity 120 to be at atmospheric pressure while the rest of the linac 110 is held at a vacuum. The insulating material is of course non-conducting, so the electric field lines pass through to the coupling cavity 120. Therefore the conductive vane 122 continues to affect the rf signal passing down the linac 110, according to its particular angle of rotation. In one embodiment, the insulating material may have a dielectric property, with a dielectric constant which is generally higher than that of vacuum. This can have an effect on the resonant frequency of the coupling cavity 120, and can be compensated for by reducing the dimensions of the cavity relative to those without dielectric materials. The space sealed off by the partitions can be filled for example with air or a dielectric gas such as $SF_6$; the latter provides a higher resistance to RF breakdown.

As the vane 122 is no longer under vacuum, more conventional means can be used to drive the rotation, and higher rotational speeds can be achieved without compromising the vacuum in the accelerating cells 114, 116. For example, the rotating mechanism can be coupled directly to the vane 122 from outside the coupling cavity 120. In addition, the absence of flexible bellows 52 means the "bakeout" temperature can be higher, increasing the sterility of the system.

Figure 4:
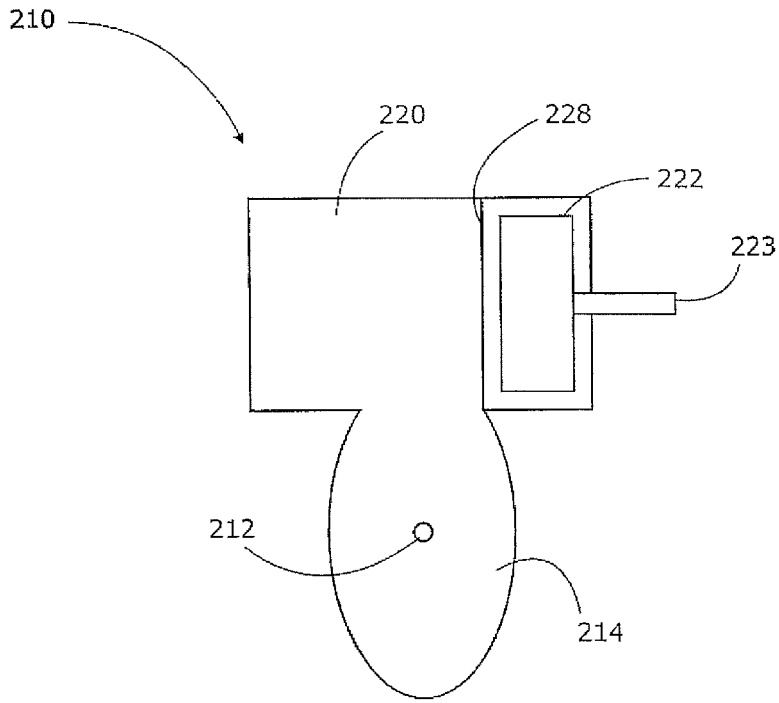
FIG. 4 shows a linear accelerator according to a further embodiment of the present invention.

FIG. 4 shows a linac 210 according to further embodiments of the present invention. The view is in an orthogonal orientation compared to previous Figures, to show the embodiment most clearly. The beam axis 212 extends into the page, with adjacent accelerating cells 214 and 216 (not illustrated) likewise extending into the page.

The rotatable vane 222 is again sealed off from the accelerating cavities by means of a ceramic partition 228. However, in this embodiment a single ceramic partition 228 extends across the coupling cavity 220, transverse to the axis of rotation of the vane 222, from the edge of the accelerating cavity 214 opening to the other side. The vane 222 is correspondingly shorter, to fit within the shorter chamber defined by the partition 228, and extends across less than half the length of the coupling cavity 220.

This design is easier to manufacture than that shown in FIG. 3. However, in certain modes it would be desirable for the vane 222 to extend the entire length of the coupling cavity 220.

Figure 5:
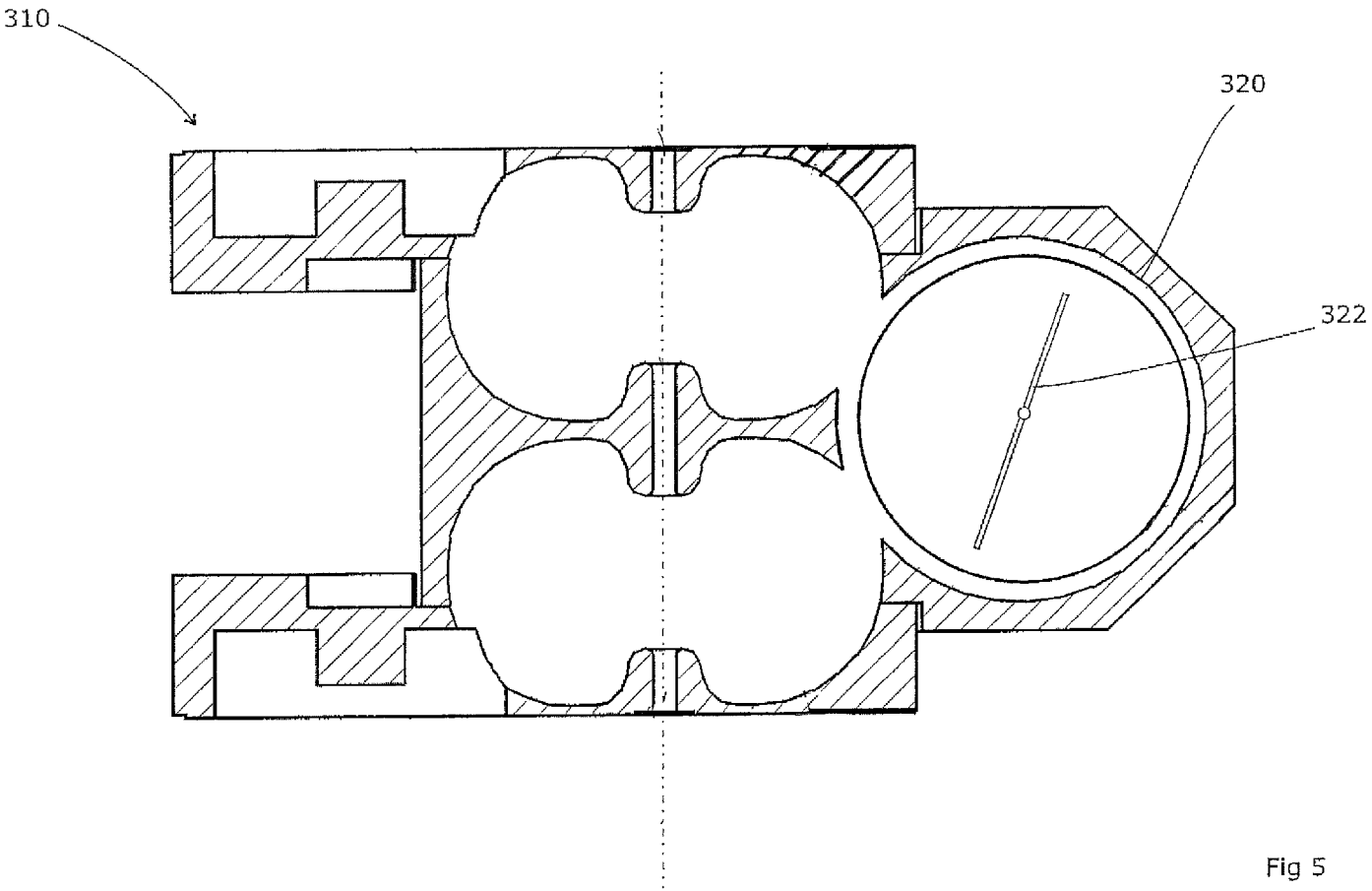
FIG. 5 shows a linear accelerator according to a yet further embodiment of the present invention.
Figure 6:
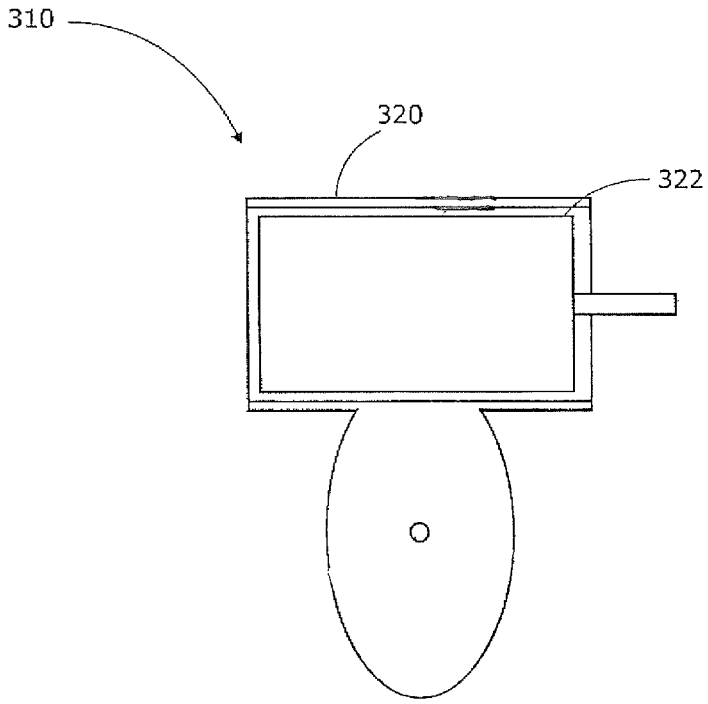
FIG. 6 shows the linear accelerator of FIG. 5 at an alternative elevation.

FIGS. 5 and 6 show orthogonal views of a linac 310 according to a yet further embodiment of the present invention.

In this embodiment, a single cylindrical ceramic partition extends around the vane 322 entirely within the coupling cavity 320. The longitudinal axis of the cylinder runs parallel to the rotation axis of the vane 322, so the vane fits within the partition at all angles of rotation. The vane 322 is therefore free to extend the full length of the coupling cavity 320 so as to provide the maximum possible influence on the electromagnetic wave as it propagates down the linear accelerator.

The present invention therefore provides a linear accelerator in which a rotatable conductive vane is employed to vary the electromagnetic coupling between adjacent accelerating cells. The vane is sealed off from the rest of the linear accelerator by an insulating (and air-tight) partition, so that the pressure around the vane can be higher than in the rest of the accelerator. This greatly simplifies the mechanisms which may be used to control the rotation of the vane, allowing a higher bakeout temperature in manufacture and a higher rate of rotation in use.

It will of course be understood that many variations may be made to the above-described embodiment without departing from the scope of the present invention.

Although the present invention has been described with reference to preferred embodiments, workers skilled in the art will recognize that changes may be made in form and detail without departing from the spirit and scope of the invention.

What is claimed is:

1. A linear accelerator, comprising:

a plurality of accelerating cavities arranged in a linear array, adjacent pairs of which are electromagnetically coupled via respective coupling cavities; and an electrically insulating partition;

wherein at least one of said coupling cavities comprises a conductive element that is rotatable, thereby to vary the coupling offered by that coupling cavity;

wherein the electrically insulating partition defines a first region, containing the conductive element, having a first gaseous pressure, and a second region having a second gaseous pressure, the second gaseous pressure being lower than the first gaseous pressure.

2. The linear accelerator according to claim 1, wherein the conductive element comprises a flat vane.

3. The linear accelerator according to claim 2, wherein the flat vane extends across substantially the entire length of the coupling cavity.

4. The linear accelerator according to claim 2, wherein the flat vane extends across less than half the length of the coupling cavity.

5. The linear accelerator according to claim 1, further comprising a coupling means extending through an external wall of the coupling cavity, for coupling the conductive element to a driving means external to the coupling cavity.

6. The linear accelerator according to claim 5, wherein the coupling means is also sealed off from said accelerating cavities by said electrically insulating partition.

7. The linear accelerator according to claim 1, wherein the electrically insulating partition comprises a cylindrical partition surrounding the conductive element.

8. The linear accelerator according to claim 7, wherein the axis of the cylindrical partition lies parallel to the axis of rotation of the conductive element.

9. The linear accelerator according to claim 1, wherein the electrically insulating partition seals off the coupling cavity from the respective adjacent accelerating cavities.

10. The linear accelerator according to claim 1, wherein the electrically insulating partition extends transverse to the axis of rotation of the conductive element.

11. The linear accelerator according to claim 1, wherein the electrically insulating partition comprises a dielectric material.

12. The linear accelerator according to claim 1, wherein the electrically insulating partition comprises a ceramic material.

13. The linear accelerator according to claim 1, wherein the electrically insulating partition comprises a material suitable for use in ultra-high vacuums.

* * * * *